US005722007A

United States Patent [19]

Ogata et al.

[11] Patent Number: 5,722,007

[45] Date of Patent: Feb. 24, 1998

[54] IMAGE FORMING APPARATUS HAVING DETECTION MEANS FOR DETECTING DENSITY OF DEVELOPER

[75] Inventors: Takao Ogata, Yokohama; Takeshi Menjo, Tokyo; Kazuo Suzuki, Yokohama, all of Japan

[73] Assignee: Canon Kabushiki Kaisha, Tokyo, Japan

[21] Appl. No.: 648,398

[22] Filed: May 15, 1996

Related U.S. Application Data

[63] Continuation of Ser. No. 529,438, Sep. 18, 1995.

[30] Foreign Application Priority Data

Sep. 19, 1994 [JP] Japan ..... 6-251231

[51] Int. Cl.[6] ..... G03G 15/10

[52] U.S. Cl. ..... 399/49; 399/53

[58] Field of Search ..... 355/246, 208; 356/445–448; 399/49, 53, 58, 60, 222, 258, 29, 30, 259; 347/188

[56] References Cited

U.S. PATENT DOCUMENTS 5,218,409 6/1993 Tanaka et al. ..... 355/246

5,387,965 2/1995 Hasegawa et al. ..... 355/246

5,424,809 6/1995 Sawayama et al. ..... 355/208

*Primary Examiner*—Arthur T. Grimley

*Assistant Examiner*—Quana Grainger

*Attorney, Agent, or Firm*—Fitzpatrick, Cella, Harper & Scinto

[57] ABSTRACT

The present invention provides an image forming apparatus comprising an electrophotographic photosensitive member, developing means using developing agent including carrier and toner, toner image forming means for forming on the photosensitive member a detection toner image by which toner density of the developing agent is detected, toner density detection means for measuring and detecting density of the detection toner image formed, judge means for judging whether the measured density of the detection toner image is included in a high detection sensitivity area of the detection means, and change means for changing or altering a toner image forming condition of the toner image forming means when the measured density of the detection toner image is not included in the high detection sensitivity area.

19 Claims, 6 Drawing Sheets

IMAGE FORMING APPARATUS HAVING DETECTION MEANS FOR DETECTING DENSITY OF DEVELOPER

This application is a continuation of application Ser. No. 08/529,438 filed Sep. 18, 1995.

BACKGROUND OF THE INVENTION

1. Field of the Invention

The present invention relates to an image forming apparatus in which an electrostatic latent image formed on an image bearing member is developed as a toner image by using developer or developing agent including toner and carrier.

2. Related Background Art

Now, conventional image forming apparatus to which the present invention can be applied will be explained.

In image forming apparatuses using developing agent including toner and carrier, in order to form an image stably, it is necessary to keep density of the developing agent (i.e. a ratio between the toner and the carrier) constant. However, when a toner image is formed, since the toner is consumed and the density of the developing agent in a developing device is changed, generally, after the density of the developing agent is detected by means of a detection means such as a optical sensor, new toner is replenished into the developing device to keep the density of the developing agent constant.

Next, a method for detecting the density of the developing agent by using the optical sensor will be described. An electrostatic latent image for density detection (referred to as "density detection latent image" hereinafter) is formed on a charged surface of a photosensitive drum (image bearing member) with a predetermined level (for example, intensity of laser light), and then, the density detection latent image is developed by means of a developing device containing developing agent including toner and carrier, thereby forming a toner image for density detection (referred to as "density detection toner image" hereinafter). Light from the optical sensor is illuminated onto the density detection toner image. An amount of light reflected from the density detection toner image is converted into a voltage. On the basis of a magnitude of the voltage, the density of the developing agent after the density detection toner image was formed is detected.

By the way, the optical sensor has an inherent property wherein the output voltage has a voltage value capable of detecting the density of the developing agent with good sensitivity. The voltage value having the good sensitivity is an output value of the sensor before the density of the developing agent is changed and a voltage value that is greatly changed when the density of the developing agent is changed. Regarding the change in the density of the developing agent, the greater the change in the output value the greater the accuracy of density detection. Conventionally, the output level upon formation of the density detection latent image was fixed at a predetermined level so that the sensor can output the voltage value having the good sensitivity when the density of the developing agent has reference or standard density.

However, since the features of laser and sensor are different for each of the image forming apparatuses, if the output level upon formation of the density detection latent image is fixed at a common level as mentioned above for all of the image forming apparatuses, it will be impossible to detect the density with good sensitivity is all of the image forming apparatuses. That is to say, for example, since the laser power and the output value of the sensor capable of detecting the density with good sensitivity are different for each of the image forming apparatuses, if the output level is fixed at the common level, although the sensor can output the voltage value having the good sensitivity so that the density of the developing agent is detected with good accuracy in some image forming apparatuses, the sensor cannot output the voltage value having the good sensitivity in the other image forming apparatuses, with the result that the density detection with good accuracy cannot be achieved.

Further, even when the density of the developing agent is maintained to the standard density, for example, and the sensor outputs the voltage value having the good sensitivity to detect the density with good accuracy, after the apparatus has been used for a long time, since an amount of the developing agent carried on a developing roller of the developing device is changed and/or an S-D gap (between the photosensitive drum and the developing roller) is changed, the sensor cannot output the voltage value having the good sensitivity, with the result that the accuracy of the density detection cannot be maintained. (For example, as shown in FIG. 3, even when the density of the developing agent is kept constant, if the S-D gap is increased due to wear of the photosensitive drum and/or the developing roller, the output voltage of the optical sensor (density detection sensor in FIG. 3) will be increased.)

SUMMARY OF THE INVENTION

An object of the present invention is to provide an image forming apparatus which can detect density of developing agent with good accuracy, regardless of inherent construction and/or feature of the image forming apparatus.

Another object of the present invention is to provide an image forming apparatus which can detect density of developing agent with good accuracy, regardless of the changes of a condition of the apparatus caused after the apparatus has been used for a long time.

The other objects of the present invention will be apparent from the following detailed description referring to the accompanying drawings.

To achieve the above objects, an image forming apparatus according to the present invention comprises an electrophotographic photosensitive member, a developing means using developing agent including carrier and toner, a toner image forming means for forming on the photosensitive drum a detection toner image from which toner density of the developing agent is detected, a toner density detection means for measuring and detecting density of the detection toner image formed, a judge means for judging whether the measured density of the detection toner image is included in a high detection sensitivity range of the detection means, and a change means for changing or altering a toner image forming condition of the toner image forming means when the measured density of the detection toner image is not included in the high detection sensitivity range.

When the carrier and the toner are contained in the developing means, the detection toner image is formed. And, when the density of the toner image measured by the toner density detection means reaches the predetermined density, further detection toner images are formed under this toner image forming condition, and the toner density of the developing agent is detected.

DESCRIPTION OF THE PREFERRED EMBODIMENTS

Figure 4:
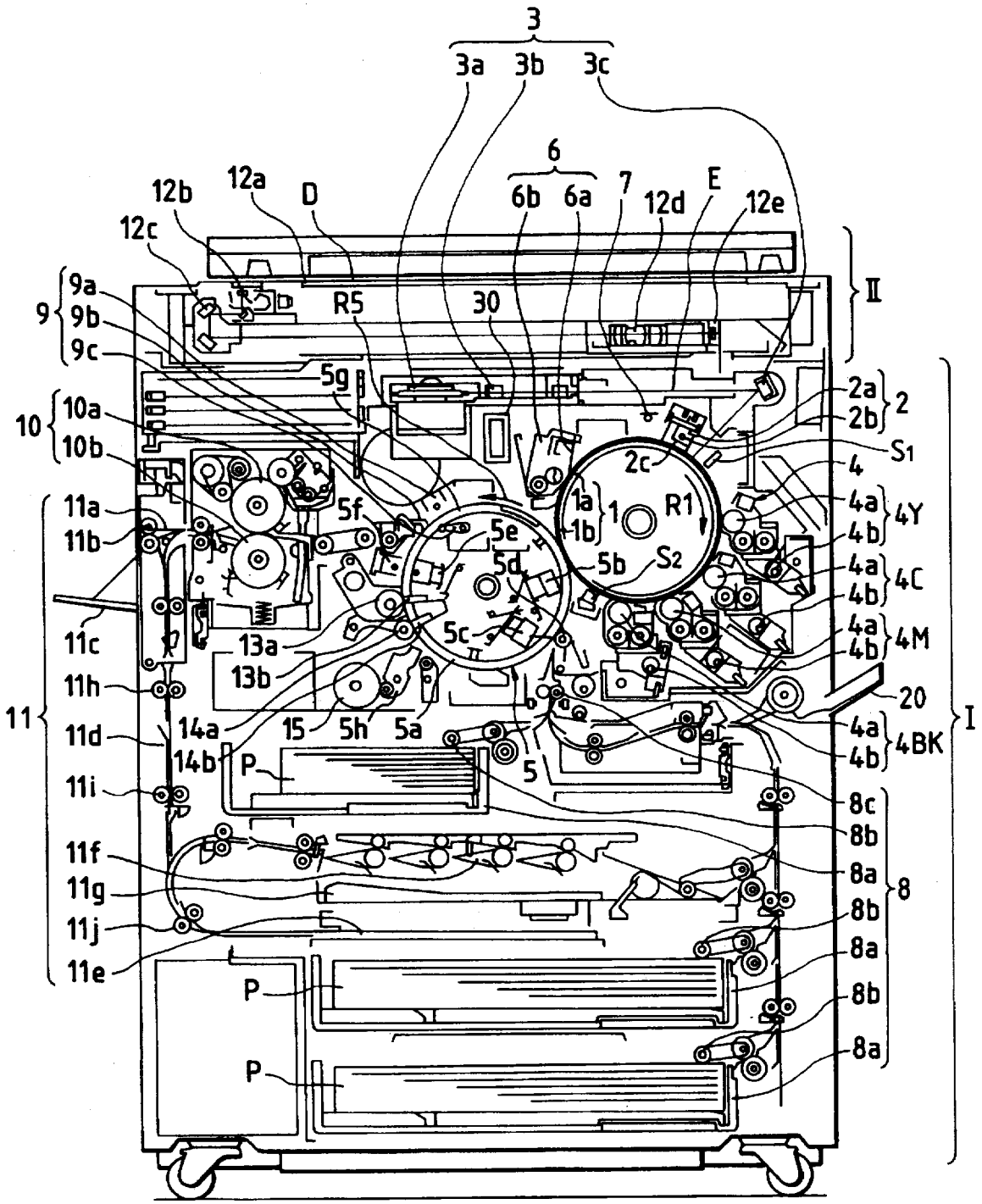
FIG. 4 is an elevational sectional view of an image forming apparatus according to the present invention.

FIG. 4 is an elevational sectional view schematically showing a construction of a (four) full-color digital electrophotographic copying machine as an example of an image forming apparatus according to the present invention.

The image forming apparatus shown in FIG. 4 comprises a lower digital color image printer portion I (referred to merely as "printer portion" hereinafter), and an upper digital color image reader portion II (referred to merely as "reader portion" hereinafter), so that, for example, on the basis of an image on an original (document) D read by the reader portion II, an image is formed on a recording sheet P by means of the printer portion I.

Now, constructions of the printer portion I and the reader portion II will be briefly described.

The printer portion I includes a photosensitive drum (image bearing member) I having an electrophotographic photosensitive layer and rotated in a direction shown by the arrow R1. Around the photosensitive drum I, along the rotational direction thereof, there are disposed, in order, a first charger (charge means) 2, an exposure means 3, a developing apparatus (developing means) 4, a transfer device 5, a cleaning device 6, a pre-exposure lamp 7 and the like. Below the transfer device 5 (i.e. within a lower half part of the printer portion I), there is disposed a sheet supply and convey portion for the recording sheet P. A separation means 9 is disposed above the transfer device 5, and a fixing device 10 and a sheet discharge portion 11 are disposed at a downstream side of the transfer device 5 (in a recording sheet P conveying direction).

The photosensitive drum I has a drum-shaped aluminum base la and an OPC (organic photo-semiconductor) photosensitive layer 1b covering the surface of the drum-shaped base, and is rotated at a predetermined process speed (peripheral speed) by means of a drive means (not shown) in a direction shown by the arrow R1. The photosensitive drum 1 will be fully described later.

The first charger 2 is a corona charger including a shield 2*a* having an opening opposed to the photosensitive drum 1, a discharge wire 2*b* disposed within the shield 2*a* in parallel with the generatrix of the photosensitive drum 1, and a grid 2*c* disposed at the opening of the shield 2*a* and capable of regulating the charge potential. When charge bias from a power source (not shown) is applied to the first charger 2, the surface of the photosensitive drum 1 is uniformly charged with predetermined polarity and predetermined potential by means of the first charger 2.

The exposure means 3 includes a laser output portion (not shown) for emitting laser light in response to an image signal from the reader portion II (fully described later), a polygon mirror 3*a* for reflecting the laser light, a lens 3*b*, and a mirror 3*c*. The exposure means 3 serves to expose the photosensitive drum 1 by illuminating the laser light onto the surface of the photosensitive drum 1, thereby removing the charge from the exposed portion to form an electrostatic image. In this case, when intensity of the laser light is changed, an amount of the removed charge is changed, the potential of the formed electrostatic image is also changed. In the illustrated embodiment, the electrostatic image to be formed on the surface of the photosensitive drum 1 is color-decomposed into an yellow component, a cyan component, a magenta component and a black component on the basis of the image on the original, and the electrostatic images corresponding to these colors are successively formed.

The developing apparatus 4 includes four developing devices 4Y, 4C, 4M and 4Bk containing resinbased yellow toner, cyan toner, magenta toner and black toner (two-component developing agent including toner and carrier), respectively, which developing devices 4Y, 4C, 4M and 4Bk are disposed in order from an upstream side along the rotational direction (R1) of the photosensitive drum 1. The developing devices 4Y, 4C, 4M and 4Bk have corresponding developing sleeves 4*a* for applying the toner to the electrostatic image formed on the photosensitive drum 1. A desired developing device selected to develop the electrostatic image is brought to a developing position adjacent to the surface of the photosensitive drum 1, by means of an eccentric cam 4*b*. The developing device positioned at the developing position applies the toner to the electrostatic image via the developing sleeve 4*a*, thereby forming a toner image (visualized image). Incidentally, in this case, the other (three) developing devices other than the developing device selected to perform the development are retarded from the developing position.

The transfer device 5 has a transfer drum (recording sheet bearing member) 5*a* for bearing the recording sheet P thereon, a transfer charger (transfer charge means) 5*b* for transferring the toner image formed on the photosensitive drum 1 onto the recording sheet P, an absorb charger 5*c* and an opposing absorb roller 5*d* for absorbing the recording sheet P to the transfer drum 5*a*, an inner charger 5*e* and an outer charger 5*f*. A peripheral opening of the transfer drum 5*a* rotated in a direction shown by the arrow R5 is covered by a cylindrical dielectric recording sheet bearing film 5*g*. The recording sheet bearing film 5*g* is formed from a dielectric film such as polycarbonate film. The transfer device 5 serves to absorb and bear the recording sheet P on the transfer drum 5*a*.

The cleaning device 6 includes a cleaning blade 6*a* for scraping the residual toner remaining on the photosensitive drum 1 (not transferred to the recording sheet P), and a cleaning container 6*b* for collecting the scraped toner. The pre-exposure lamp 7 is disposed adjacent to the first charger 2 at an upstream side thereof and serves to remove the residual charge from the photosensitive drum 1 cleaned by the cleaning device 6. The sheet supply and convey portion 8 includes a plurality of sheet supply cassettes 8*a* containing the recording sheets P having various sizes, a sheet supply rollers 8*b* associated with the corresponding cassettes and serving to supply the recording sheet P from the corresponding cassettes, a plurality of convey rollers and a pair of regist rollers 8*c*. The sheet supply and convey portion serves to supply the desired recording sheet P to the transfer drum 5*a*.

The separation means 9 includes a separation charger 9*a*, a separation pawl 9*b* and a separation pushup roller 9*c* which serve to separate the recording sheet P from the transfer drum 5*a* after the toner images are transferred to the recording sheet P. The fixing device 10 comprises a fixing roller 10*a* having a heater therein, and a pressure roller lob disposed below the fixing roller 10*a* and serving to urge the recording sheet P against the fixing roller 10*a*.

The sheet discharge portion 11 is disposed at a downstream side of the fixing device 10 and includes a convey path switching guide 11*a*, discharge rollers 11*b*, and a discharge tray 11*c*. Further, below the convey path switching guide 11*a*, there are disposed a vertical convey path 11*d*, a reverse rotation path 11*e*, a sheet stacking member 11*f*, an intermediate tray 11*g*, convey rollers 11*h*, 11*i*, and a reverse rotation roller 11*j* which are used to form images on both surfaces of the recording sheet P.

Figure 5:
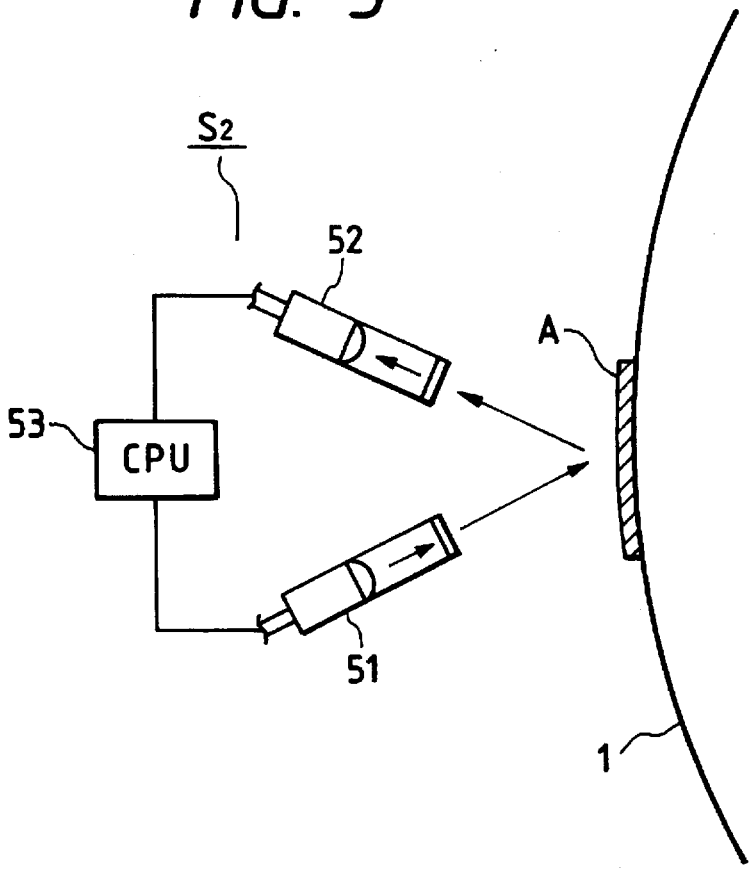
FIG. 5 is a schematic illustration for explaining a construction of the optical sensor.
Figure 6:
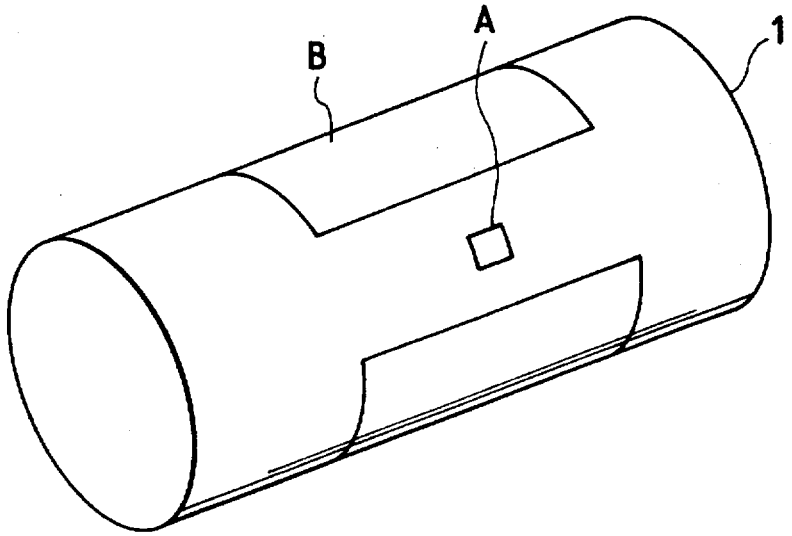
FIG. 6 is a perspective view showing a condition that a patch image is formed on a non-image area of a photosensitive drum.

Further, around the photosensitive drum 1, a potential sensor $S_1$, for detecting charge potential on the surface of the photosensitive drum is disposed between the first charger 2 and the developing apparatus 4, and a density sensor $S_2$ for detecting density of the toner image formed on the surface of the photosensitive drum 1 is disposed between the developing apparatus 4 and the transfer drum 5*a*. The density sensor $S_2$ will be fully described hereinbelow. As shown in FIG. 5, the density sensor $S_2$ is constituted by an optical sensor including a light emitting portion 51, a light receiving portion 52, and a CPU 53. Illumination light emitted from the light emitting portion 51 is reflected by a patch image A (density detection toner image) formed on the surface of the photosensitive drum 1, and the reflected light is received by the light receiving portion 52. In this case, an amount of the reflected light is converted into an output voltage of the density sensor $S_2$ by means of the CPU 53.

Now, the reader portion II will be explained. The reader portion II disposed above the printer portion I includes an original support glass 12*a* on which the original D is rested, a shiftable exposure lamp 12*b* for scanning an imaged surface of the original D, a plurality of mirrors 12*c* for reflecting the light reflected from the original, a lens 12*d* for condensing the reflected light, and a full-color sensor 12*e* for forming a color decomposed image signal on the basis of the light from the lens 12*d*. The color decomposed image signal is sent, through an amplifier circuit (not shown), to a video treatment circuit (not shown), where the signal is treated, and the treated signal is sent to the printer portion I.

Next, an operation of the above-mentioned image forming apparatus will be briefly explained. Incidentally, in the following description, the full-color (four color) image formation with yellow, cyan, magenta and black colors will be described.

The image of the original S rested on the original support glass 12*a* of the reader portion II is illuminated by the light from the exposure lamp 12*b*, and then is color-decomposed. As a result, the yellow image component is firstly read by the full-color sensor 12*e* and then is treated. The treated image component is sent to the printer portion I as the image signal.

In the printer portion I, the photosensitive drum 1 is rotated in the direction R1 and is uniformly charged by the first charger 2. On the basis of the image signal sent from the reader portion II, the laser light is emitted from the laser output portion of the exposure means 3, which laser light exposes the charged surface of the photosensitive drum 1 via the polygon mirror 3*a* and the like. The charge is removed from the exposed surface portion of the photosensitive drum 1, thereby forming the electrostatic image corresponding to the yellow color. In the developing apparatus 4, the yellow developing device 4Y is positioned at the predetermined developing position, and the other developing devices 4C, 4M and 4Bk are retarded from the developing position. The electrostatic image formed on the photosensitive drum 1 is visualized with the yellow toner from the developing device 4Y as the yellow toner image.

The yellow toner image formed on the photosensitive drum 1 is transferred onto the recording sheet P born on the transfer drum 5*a*. In this respect, a recording sheet P having size suitable to receive the image is supplied from the selected sheet supply cassette 8*a* to the transfer drum 5*a* via the sheet supply roller 8*b*, convey rollers and the paired regist rollers 8*c* at a predetermined timing. The recording sheet P supplied in this way is absorbed to the transfer drum 5*a* to be wound around the latter. While the recording sheet P is rotated together with the transfer drum 5*a* in the direction R5, the yellow toner image formed on the photosensitive drum 1 is transferred onto the recording sheet by means of the transfer charger 5*b*.

On the other hand, after the toner image was transferred to the recording sheet, the residual toner remaining on the photosensitive drum 1 is removed by the cleaning device 6, and then, the residual charge remaining on the photosensitive drum is also removed by the pre-exposure lamp 7 for preparation for next image formation starting from the first charger 2.

The above-mentioned continuous processes (from the reading of the original image by means of the reader portion II to the cleaning and electricity removal regarding the photosensitive drum 1) are similarly performed with respect to the cyan, magenta and black colors. In this way, four color toner images are successively transferred to the same recording sheet P on the transfer drum 5*a* in a superimposed fashion.

The recording sheet P to which the four color toner images were transferred is separated from the transfer drum 5*a* by means of the separation charger separation pawl 9*b* and the like, and the separated recording sheet P on which the non-fixed toner images were formed is sent to the fixing device 10. This recording sheet P is heated and pressurized by the fixing roller 10*a* and the pressure roller 10*b* of the fixing device 10, with the result that the toner images on the recording sheet are fused and mixed so that they are fixed to the recording sheet as a full-color image. After the fixing operation, the recording sheet P is discharged onto the discharge tray 11*c* by the discharge rollers 11*b*. Incidentally, when it is desired to form images on both surfaces of each recording sheet P, after the recording sheet P is discharged from the fixing device 10, the recording sheet P is sent to the vertical convey path 11*d* by switching the convey path switching guide 11*a* and then is introduced into the reverse rotation path 11*e* temporarily. Then, by rotating the reverse rotation roller 11*j* reversely, the recording sheet P is returned to a direction opposite to a direction that the recording sheet is introduced into the reverse rotation path. In this case, a trail end of the introduced recording sheet becomes a tip end (leading end). The returned recording sheet is sent to the intermediate tray 11*g*. Thereafter, the recording sheet P is sent to the transfer drum again, where the toner images are transferred onto the other surface of the recording sheet in the same manner as mentioned above. Then, the sheet is sent to the fixing device again, where the toner images are fixed to the other surface of the recording sheet as the full-color image. Thereafter, the recording sheet is discharged onto the discharged tray 11*c*.

Regarding the transfer drum 5*a* from which the recording sheet P was separated, in order to prevent the floating toner from adhering to the recording sheet bearing film 5*g* of the drum and to prevent oil from adhering to the recording sheet P, the recording sheet bearing film 5g is cleaned by a fur brush 13a and a back-up brush 13b which are opposed to each other with the interposition of the recording sheet bearing film 5g and by an oil removing roller 14a and a back-up brush 14b which are opposed to each other with the interposition of the recording sheet bearing film. Incidentally, such cleaning can be performed before or after the image formation is started, and is always performed if the recording sheet is jammed.

Next, a method for detecting the density of the developing agent embodying the feature of the present invention will be explained with reference to FIG. 1.

When the color toner and the carrier are supplied into the developing device of the image forming apparatus of FIG. 4, the concept of the present invention is applied. The supply of the toner and the carrier is effected firstly when toner and carrier are newly supplied to the developing device after the apparatus is assembled in the factory. Further, when the developing agent is repeatedly used while the toner is sometimes replenished, the carrier is gradually deteriorated and ultimately cannot be used. As a result, the deteriorated carrier must be changed to new carrier. Also in this case, the supply of the toner and the carrier is effected.

Figure 1:
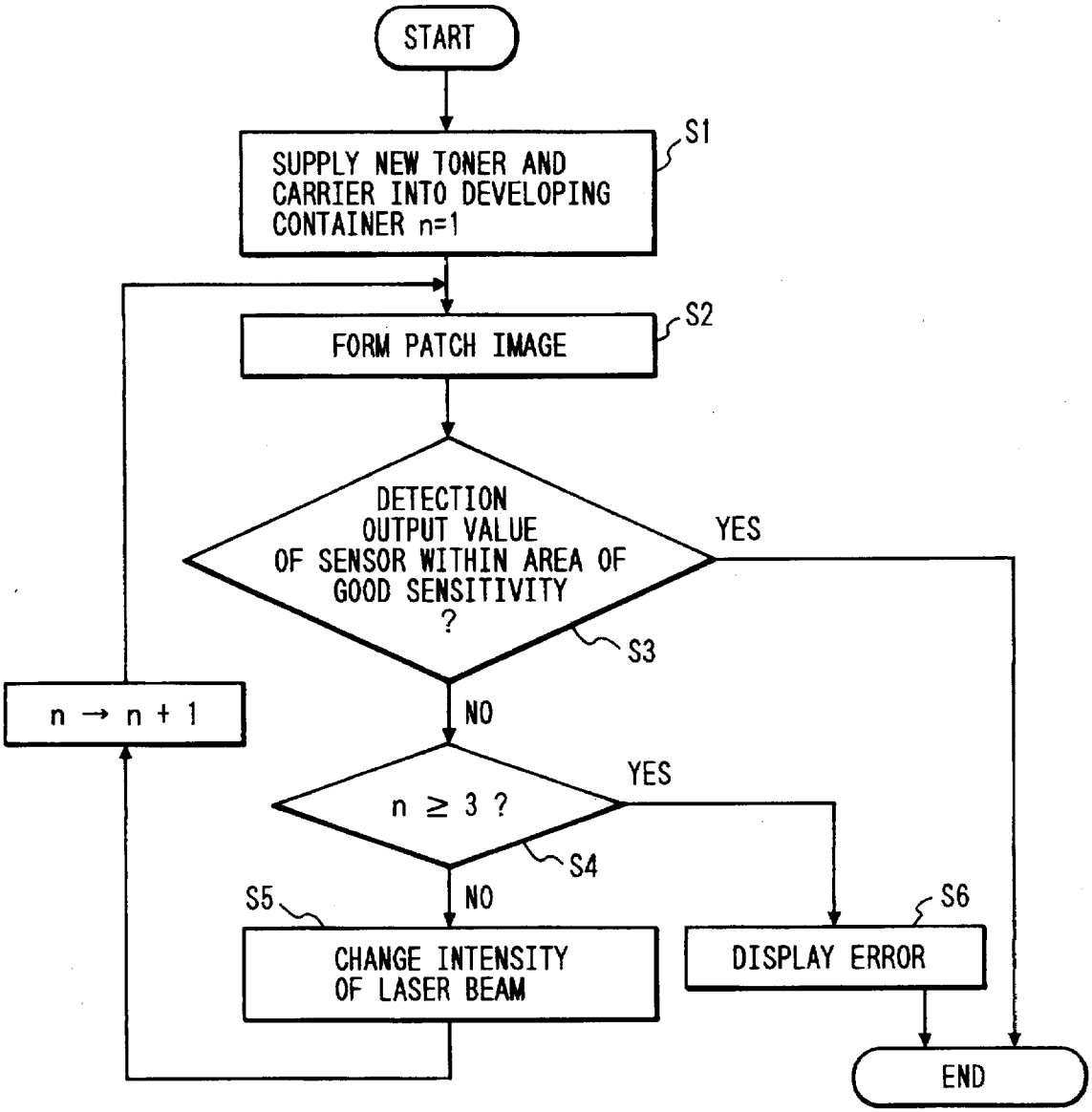
FIG. 1 is a flow chart for carrying out the present invention.

As shown in FIG. 1, the concept of the present invention is applied after the new carrier and toner is supplied in this way (step S1).

The patch image is firstly formed on the photosensitive drum by using the carrier and toner supplied in this way (step S2). Then, the patch image is detected by the sensor, and it is determined whether the output voltage of the sensor is included within a predetermined area (step S3). This area is a range having good sensitivity of the sensor. Such area will be fully described later.

The fact that the formed patch image is not included within the predetermined area means that the formed patch image is not a patch image which meets with the good sensitivity of the sensor. Accordingly, if the patch image is not included within the predetermined area, a condition for forming the electrostatic image is changed to alter the density of the patch image. Then, the newly formed patch image is detected by the sensor. The alteration of the electrostatic image forming condition may be performed by changing the intensity of the laser beam from the optical system or by changing the charged amount of the photosensitive drum. In the illustrated embodiment, the electrostatic image forming condition is altered by changing the intensity of the laser beam from the optical system (step S5).

If it is judged that formed is included within the predetermined area, the electrostatic image forming condition for the patch image formation is fixed and stored in a memory, and the series of sequences for setting the electrostatic image forming condition is ended.

On the other hand, if the patch image is not included within the predetermined area after the reformation of the patch image is repeated by three times (step S4), abnormality as "error" is displayed on the apparatus (step S6), and the sequence is stopped.

Next, the detection of the density sensor will be explained with reference to FIG. 5.

As shown in FIG. 5 and as mentioned above, the density sensor $S_2$ is the optical sensor including the light emitting portion 51, light receiving portion 52, and CPU 53. The illumination light emitted from the light emitting portion 51 is reflected by the patch image A (density detection reference toner image) formed on the surface of the photosensitive drum 1, and the reflected light is received by the light receiving portion 52. In this case, the amount of the reflected light is converted into the output voltage of the density sensor $S_2$ by means of the CPU 53. The patch image A is formed on a non-image forming area positioned out of an image forming area B on the photosensitive drum 1 after the new toner and carrier are supplied to the developing device. The patch image A is formed in the following manner. That is to say, an electrostatic patch latent image is formed by exposing the charged surface of the photosensitive drum 1 by means of the exposure means 3, and then, the patch latent image is developed with the developing agent (toner) included in the developing apparatus 4, thereby forming the patch image A.

Incidentally, when the new toner and carrier are supplied to the developing device, since the predetermined toner and carrier are used, the density of the developing agent is known even if the density of the developing effected. Accordingly, in this case, since the density of the developing agent used to form the patch image A is known, the patch image may be formed so that the known density is reached.

In this case, the density of the patch image A can be changed relatively easily, for example, by changing the intensity of the laser light. Accordingly, the intensity of the laser light (image density output level) for firstly exposing the surface of the photosensitive drum 1 may be set so that the output voltage of the optical sensor $S_2$ corresponding to the density of the patch image formed by this laser light is included within an area which is assumed to have the good sensitivity. In this regard, unlike to the conventional techniques in which the image density output level is fixed at a predetermined value, in accordance with the present invention, the image density output level can be appropriately changed on the basis of the detection result of the density of the patch image.

Next, a method for changing the image density output level will be explained.

Figure 2:
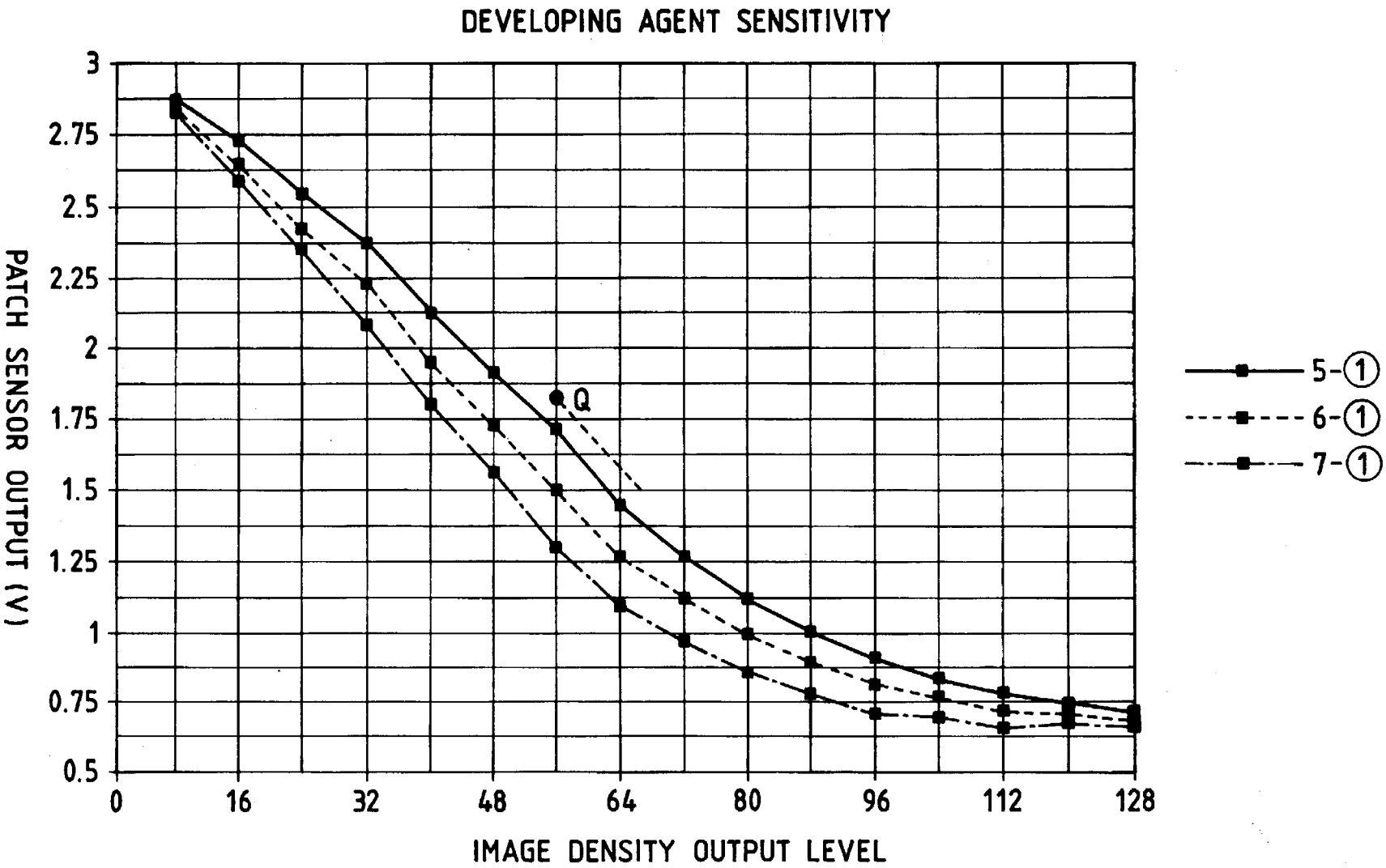
FIG. 2 is a graph showing a relation between an image density output level and an optical sensor output voltage.

First of all, the good sensitivity area of the sensor will be described with reference to FIG. 2. FIG. 2 is a graph showing a relation between the image density output level (abscissa) and the output (ordinate) of the optical sensor (patch sensor in FIG. 2) when the density of the developing agent is 5%, 6% and 7%, respectively.

As apparent from FIG. 2, when the image density output level is 58, the optical sensor $S_2$ has best sensitivity. Incidentally, the best sensitivity means an area where the output voltage of the optical sensor $S_2$ is greatly varied with the change in density of the developing agent. For example, in the case where the standard density of the developing agent is 6%, when the output voltage of the optical sensor $S_2$ is 1.5V at the image density output level of 58, the best sensitivity is achieved. That is to say, the optical sensor $S_2$ has the best sensitivity when the output voltage thereof is 1.5 V and therearound. Accordingly, upon detection of the density of the patch image A, when the output voltage of the optical sensor $S_2$ is 1.5 V, the best accuracy can be obtained.

Figure 3:
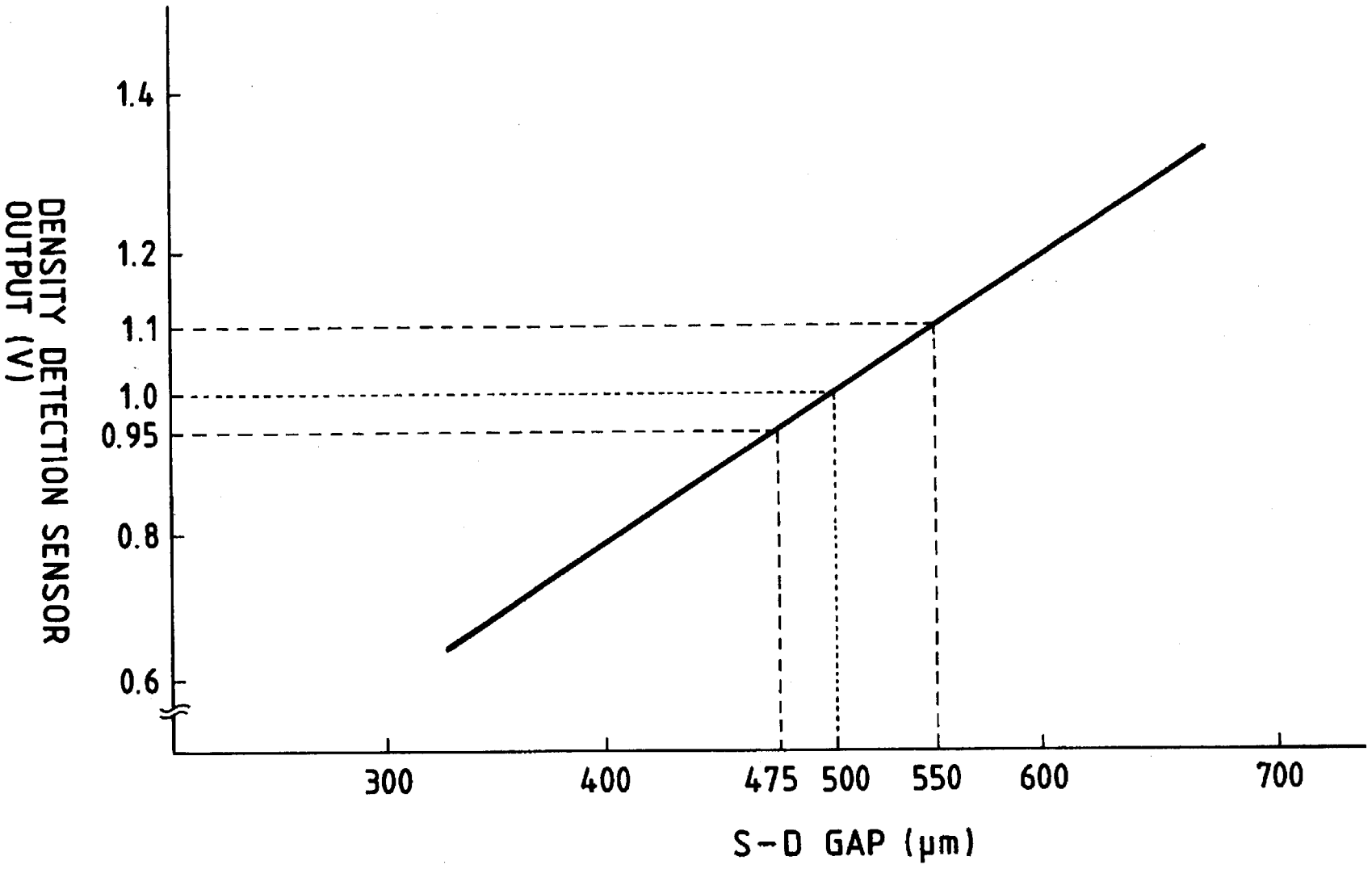
FIG. 3 is a graph showing a relation between an S-D gap and a density detection sensor output voltage.

By the way, the relation between the image density output level and the output voltage of the optical sensor $S_2$ shown in FIG. 2 is not fixed, and, as mentioned above, is varied with the change in the S-D gap and the like. When the S-D gap is increased, as shown in FIG. 3, the output of the optical sensor is also increased. For example, in FIG. 2, at the image density output level of 58, it is assumed that, although the output voltage of the sensor $S_2$ is 1.5 V before the S-D gap is increased, the output voltage of the sensor is increased to 1.8 V (point Q in FIG. 2) as the S-D gap is increased. In this case, when the density of the developing agent in the developing device has the standard density (6% in FIG. 2), since the sensitivity of the optical sensor $S_2$ is bad at the sensor output of 1.8 V and therearound, the sensor output is decreased to 1.5 V. The difference in the image density output levels corresponding to the difference (0.3 V) in the output voltages is about 10 (in level) as apparent from FIG. 2. Accordingly, by increasing the image density output level by 10 (in level) up to 68 (=58+10), the output of the optical sensor $S_2$ can be brought to the good sensitivity area.

In the manufacture of the image forming apparatus, since the data shown in FIG. 3 or the change in output voltage per 1 level is stored in a ROM of the apparatus, the image density output level used in the actual image formation can be altered on the basis of such data. By doing so, the density of the developing agent can always be detected correctly.

Incidentally, the above numerical values are merely shown as an example, and, in effect, since such values are changed in accordance with the inherent features of the image forming apparatus and the optical sensor $S_2$ and the property of the developing agent, such values may be changed appropriately in dependence upon the actual condition.

Figure 7:
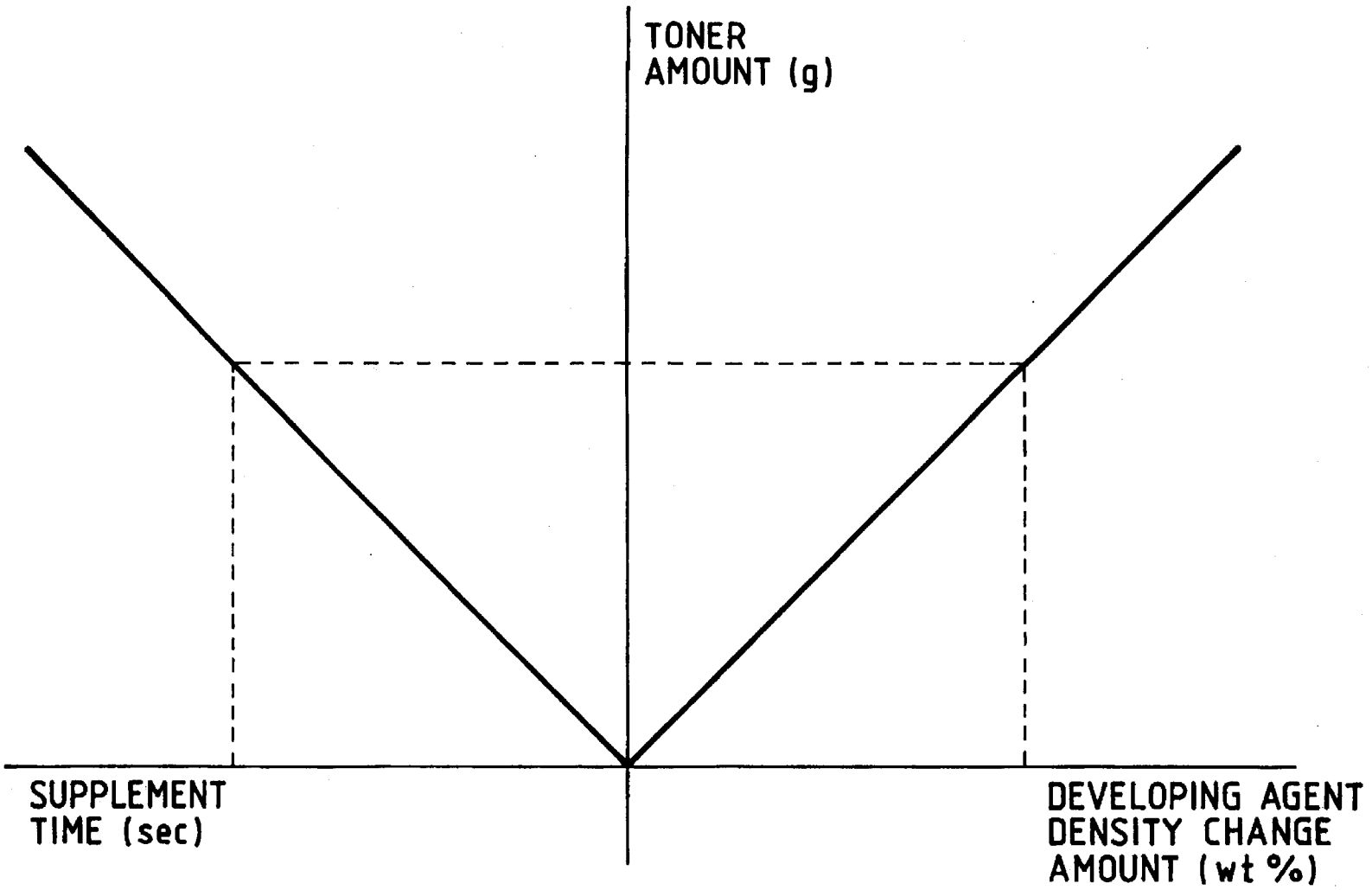
FIG. 7 is a graph showing a relation between a developing agent density change amount and a toner supply time.

After the density of the developing agent is correctly detected as mentioned above, as shown in FIG. 7, by properly setting the supply time on the basis of the relation between the density change amount to be changed and the toner supply time, the correct density of the developing agent can be obtained.

When the change in the image density output level is effected by predetermined times (for example, three time), if the output voltage of the optical sensor $S_2$ is not included within the good sensitivity area, since it can be judged that the optical sensor $S_2$ and/or the exposure means is abnormal or the S-D gap and/or the deterioration of the photosensitive drum exceeds the limit, the check of the apparatus is required.

Incidentally, in the present invention, after the patch image forming condition is set, when the detection of the density of the developing agent is effected for each recording sheet and when the toner is replenished into the developing device for each recording sheet, the density of the developing agent can be controlled effectively.

As mentioned above, since the detection result (output voltage) of the patch image is influenced upon the change in the developing agent supplying ability of the developing roller and/or the change in the S-D gap, the output voltage of the sensor sometimes is not included within the good sensitivity area of the sensor, depending upon the degree of such change.

However, according to the present invention, so long as the relation between the image density output level and the output voltage of the density sensor was previously determined, the change amount of the image density output level can be calculated on the basis of such a relation so that the output voltage of the density sensor is included within the good sensitivity area, and, on the basis of the calculated result, the image density output level can be changed so that the output voltage of the density sensor is included within the good sensitivity area. Accordingly, even if the detection result of the density sensor is not included within the good sensitivity area, the output voltage can always be included within the good sensitivity area, thereby detecting the density of the developing agent with high accuracy.

In this way, by changing the image density output level is changed whenever the toner and the carrier are supplied to the developing apparatus, the detection accuracy of the density of the developing agent can be standardized for all of the image forming apparatuses regardless of the inherent features of the apparatuses, thereby detecting the density of the developing agent correctly.

What is claimed is:

1. An image forming apparatus comprising:

an electrophotographic photosensitive member;

developing means using a developing agent including a carrier and a toner;

toner image forming means for forming on said photosensitive member a detection toner image by which a toner density of the developing agent is detected;

toner density detection means for measuring and detecting density of the detection toner image formed;

judge means for judging whether the measured density of the detection toner image is included in a high detection sensitivity area of said detection means; and change means for changing a toner image forming condition of said toner image forming means based on the detected result, when the measured density of the detection toner image is not included in the high detection sensitivity area;

wherein when the carrier and the toner are supplied to said developing means the detection toner image is formed, and, when the density of the toner image measured by said toner density detection means reaches a predetermined density another detection toner image is formed under this toner image forming condition, and the toner density of the developing agent is detected on the basis of density of the further detection toner image.

2. An image forming apparatus according to claim 1, wherein, when the image forming apparatus is newly assembled, the carrier and the toner are supplied to said developing means.

3. An image forming apparatus according to claim 1, wherein, when the developing agent in said developing means is deteriorated and to be replaced by new developing agent, the carrier and the toner are supplied to said developing means.

4. An image forming apparatus comprising:

an electrophotographic photosensitive member;

a developing apparatus using a developing agent including a carrier and a toner;

a charger and exposure optical system for forming on said photosensitive member a detection toner image by which toner density of the developing agent is detected;

a toner density detector for measuring and detecting density of the detection toner image formed, by using a light source and a light receiving element; and a control circuit for judging whether the measured density of the detection toner image is included within a high light receiving sensitivity area of said light receiving element of said detector, said control means changing a detection toner image forming condition if it is judged that the measured density of the detection toner image is not included within said high light receiving sensitivity area on the basis of a judged result, and for causing said charge and exposure optical system to form the detection toner image under a previous detection toner image forming condition if it is judged that the measured density of the detection toner image is included within said high light receiving sensitivity area.

5. An image forming apparatus according to claim 4, wherein, when the image forming apparatus is newly assembled, the carrier and the toner are supplied to said developing apparatus.

6. An image forming apparatus according to claim 4, wherein, when the developing agent in said developing apparatus is deteriorated to be replaced by new developing agent, the carrier and the toner are supplied to said developing apparatus.

7. An image forming apparatus according to claim 4, wherein said developing apparatus is a color developing apparatus using color toner and carrier.

8. An image forming apparatus according to claim 4, wherein the detection toner image forming condition is changed by changing an amount of light of said exposure optical system.

9. An image forming apparatus according to claim 8, wherein said exposure optical system is a laser optical system.

10. An image forming apparatus according to claim 4, wherein said control circuit causes the image forming apparatus to display abnormality if it is judged that the measured density of the detection toner image is not included within said high light receiving sensitivity area after the toner image forming condition is changed by predetermined times.

11. A color image forming apparatus comprising:

an electrophotographic photosensitive member;

a plurality of color developing devices each using developing agent including carrier and toner;

a charger and exposure optical system for forming a detection toner image by which toner density of the developing agent is detected, on a non-imaging area of said photosensitive member;

a toner density detector for measuring and detecting density of the detection toner image formed, by using a light source and a light receiving element; and a control circuit for judging whether the measured density of the detection toner image is included within a high light receiving sensitivity area of said light receiving element of said detector, said control means changing a detection toner image forming condition if it is judged that the measured density of the detection toner image is not included within said high light receiving sensitivity area on the basis of a judged result and for causing said charge and exposure optical system to form the detection toner image under a previous detection toner image forming condition if it is judged that the measured density of the detection toner image is included within said high light receiving sensitivity area;

wherein when the toner and carrier are supplied to said developing device, the detection toner image forming condition is set through said control circuit.

12. An image forming apparatus according to claim 11, wherein, when the image forming apparatus is newly assembled, the carrier and the toner are supplied to said developing apparatus.

13. An image forming apparatus according to claim 11, wherein, when the developing agent in said developing apparatus is deteriorated and to be replaced by new developing agent, the carrier and the toner are supplied to said developing apparatus.

14. An image forming apparatus, comprising:

an image bearing member;

electrostatic image forming means for forming an electrostatic image on said image bearing member, said electrostatic image forming means capable of forming a test electrostatic image;

developing means for developing the electrostatic image by a toner;

detection means for detecting an image density of a test toner image obtained by developing a test electrostatic image;

control means for controlling an image forming conditions based on a detected output by said detection means; and setting means for setting a condition to form the test electrostatic image of said electrostatic image forming means based on the detected output by said detection means.

15. An image forming apparatus according to claim 14, said developing means develops the electrostatic image by a two-component developer having a toner and a carrier, and said control means controls a toner amount to be supplied to said developing means.

16. An image forming apparatus according to claim 14, wherein said developing means develops the electrostatic image by a two-component developer having a toner and a carrier, and the image forming condition of the test electrostatic image by said setting means is set upon supplementing or exchanging the carrier.

17. An image forming apparatus according to claim 14, wherein said setting means forms the test electrostatic image in a different image forming condition thereof, and sets the image forming condition in which the detected output of said detection means gets in a predetermined range.

18. An image forming apparatus according to claim 17, further comprising alarm means for displaying an error when the detected output of said detection means does not get in the predetermined range, despite the test electrostatic images are formed by a predetermined time under a different condition.

19. An image forming apparatus according to claim 17, wherein said detection means has a detection sensor, and the predetermined range corresponds to a high sensitivity area of the detection sensor.

* * * * *